US005577444A

United States Patent [19]

Toyama

[11] Patent Number: 5,577,444

[45] Date of Patent: Nov. 26, 1996

[54] HAND STAMP

[75] Inventor: Tetsuyuki Toyama, Kanizawa, Japan

[73] Assignee: Yamahachi Chemical Co., Ltd., Gamagori, Japan

[21] Appl. No.: 168,641

[22] Filed: Dec. 16, 1993

Related U.S. Application Data

[63] Continuation-in-part of Ser. No. 81,423, Jun. 22, 1993, abandoned.

[30] Foreign Application Priority Data

Nov. 2, 1993 [JP] Japan ..... 5-274457

[51] Int. Cl.[6] ..... B41F 27/00

[52] U.S. Cl. ..... 101/379; 101/327

[58] Field of Search ..... 101/103, 104, 101/108, 109, 110, 327, 333, 368, 370, 379, 380, 405, 406

[56] References Cited

U.S. PATENT DOCUMENTS

| | | | |
|---|---|---|---|
| 1,939,612 | 12/1933 | Rose | 401/207 |
| 2,584,908 | 2/1952 | Oblinger | 101/333 |
| 3,298,055 | 1/1967 | Schwartzmann | 401/206 |
| 3,306,192 | 2/1967 | McFarland et al. | 101/333 |
| 3,464,775 | 9/1969 | Beal | 401/199 |
| 3,625,143 | 12/1971 | Nettesheim | 101/327 |
| 3,714,308 | 1/1973 | Nettesheim | 101/327 |
| 3,885,495 | 5/1975 | Funahashi | 101/327 |
| 5,123,349 | 6/1992 | Beaver et al. | 101/333 |

FOREIGN PATENT DOCUMENTS

| | | | |
|---|---|---|---|
| 0042595 | 12/1981 | European Pat. Off. | 101/327 |
| 0159388 | 9/1984 | Japan | 101/333 |
| 4363285 | 12/1992 | Japan . | |

*Primary Examiner*—Ren Yan

*Attorney, Agent, or Firm*—Cohen, Pontani, Lieberman, Pavane

[57] ABSTRACT

A hand stamp has a holder means which includes an ink storing space and a stamping member connected each other, the stamping member is made of an open-cell foam material partially heat sealed to form an ink impermeable area with a remained area for ink permeation to effect a printing, the ink impermeable area defining intaglio portions is formed by press in the heat sealing process and the ink permeable portions defining relief portions effect the printing, wherein The printing member is made immobile and attached to an opening of the holder, otherwise the printing member is made mobile and encompasses a cylindrical holder circumference, and the holder means is allowed to roll.

13 Claims, 7 Drawing Sheets

HAND STAMP

CROSS-REFERENCE TO RELATED APPLICATION

This application is a continuation-in-part of U.S. patent application Ser. No. 08/081,423, filed on Jun. 22, 1993, now abandoned.

BACKGROUND OF THE INVENTION

1. Field of the Invention

This invention relates to a hand stamp, and more particularly to a hand stamp to be stamped on stamping surfaces made of materials that generally do not absorb the stamp ink (ink non-absorbent surface), such as metals, glass or plastics, but also materials that generally absorb the stamp ink, such as paper, cloths or woods.

2. Description of the Related Art

Conventionally, the first step of the prior art for stamping a stamp mark on an ink non-absorbent surface involves the manufacture of a stamping surface by engraving a desired letter, symbol or figure (one of such letter, symbol, figure or pattern or other forms of expression or a combination of two or more of such forms of expression) on a stamping member formed of such material as rubber or metal. The second step thereof involves manual stampings using a stamp ink pad to pick up so-called permanent ink (oily ink) or quick-drying permanent ink on the stamping surface of the engraved stamping member. The last step involves pressing such stamping surface on an ink non-absorbent stamping surface made of metal, glass or plastics.

Repetition of such stampings in accordance with the above process requires the step of picking up the ink on the stamping surface by pressing the stamp on the stamp ink pad before each time of the stamping, which causes burdensome problem to those who wish to do such a job quickly or consecutively. To overcome such drawback, there has been developed a new stamp, wherein the stamping member was manufactured with a material permeable to the stamp ink, the stamping member was attached on one end of the stamping member holder, the ink was housed inside of the holder, and the ink was allowed to ooze out gradually on the stamping surface thereof, thereby eliminating the need of using the stamp ink pad.

However, the new stamp allows the ink to ooze out of the entire surface of the stamping surface. In other words, the ink is allowed to ooze out of a stamping portion defining a letter, symbol or figure which projects from the stamping surface (generally called relief part) and also out of a non-stamping portion having a height lower than the stamping portion (generally called intaglio part).

Therefore, the new stamp has a drawback of allowing the ink out of the non-stamping portion and causing more chances to stain the stamping surface to be stamped, when the stamping portion does not contact the surface to be stamped with accurate perpendicularity, or when the area of the stamping portion is too small as compared with the non-stamping portion, or when the stamping portion is only localized in the center of the stamping surface, or when the force applied is too strong to stamp the stamp. Besides, the ink housed in the holder oozes out not only from the stamping portion but also from the non-stamping portion. Consequently, the ink evaporates so soon that an ink refilling type stamp requires a frequent refilling of the ink and that an ink disposal type stamp does not stand for long use.

SUMMARY OF THE INVENTION

This invention provides a hand stamp comprising a stamping member formed of an open-cell foam material permeable to stamp ink and a holder means for holding the stamping member, the holder means providing an ink housing space and an opening allowing the ink to pass therethrough; wherein the stamping member has a stamping surface including a stamping portion (relief) formed projectingly thereon to allow the ink passage and a non-stamping portion (intaglio) having a height lower than the stamping portion with being sealed with a heat sealing treatment to inhibit the ink passage; and the stamping member is bond attached inside the opening, and the attachment thereof is sealed with heat sealing.

Thus, in accordance with the stamp of the invention, the stamping surface of the stamping member is subjected beforehand to a heat sealing process so that the surface formed of the open-cell foam material is partially melted with conformity to a predetermined letter, symbol, figure or the like retained and then is set to form the non-stamping portion. Consequently, the foams included in the non-stamping portion are collapsed. And then, the stamping member is joiningly attached inside the opening on one end of the holder and the attached portion is set after melting with the heat sealing process. Thus, there is no fear with the prior art, such as the contact of the non-stamping portion and the attachment with a surface to be stamped will allow the stamp on the portion and the attachment to stain the stamping surface. Besides, such inventive construction will delay evaporation of the ink housed in the holder, thereby eliminating the need of frequent refilling the ink in the case of the ink refilling type stamp, and prolonging the life of the ink in the case of ink disposal type stamp.

BRIEF DESCRIPTION OF THE DRAWINGS

This invention will be detailed with reference to the drawings in which.

DETAILED DESCRIPTION OF THE PREFERRED EMBODIMENT

In this invention, an open-cell foam material constituting a stamping member is preferably formed of any of polyolefin resins such as polypropylene, polyethylene or the like. Besides, a holder for holding the stamping member is preferably formed of the same material as in the polyolefin resin family for forming the open-cell foam material which constitutes the stamping member. That is because the job of attaching the stamping member to the opening of the holder for an ink passage is permitted to use the heat sealing process wherein this art demands that materials to be melted together are of the same quality, thereby facilitating a secure heat sealing of the stamping member with the holder under the same conditions as the heat sealing for forming a non-stamping portion on the stamping member by the heat sealing process which includes melting and setting the portions of the holder and the stamping member to be melted together.

Between the ink surface and the holder there may be intervened a base for holding the stamping member and for providing one or more than one through-hole through which a stamp ink passes. Besides, in the case of an ink refilling type stamp, an opening like an ink injection port for refilling the stamp ink may be provided.

The non-stamping portion (intaglio) on the stamping surface of the stamping member is formed by melting the open-cell foam material with heat sealing process and setting the melted open-cell foam material. That is, one surface of the open-cell foam material which constitutes the stamping member is partially melted in conformity with a template, that is, with a predetermined letter, symbol, figure or the like retained (thereby constituting a stamping portion) and is set after that, while the foams on the surface of the open-cell foam material are collapsed and completely sealed to form a non-stamping portion. Then, the stamping member thus obtained is joiningly attached inside the opening of the holder for the ink passage and the attachment thereof itself is also set with a heat sealing method in a similar way.

Thus, the stamp according to this invention can prevent ink from oozing out from areas other than the stamping portion on the stamping surface. Thus, there is little fear that a contact of the portions other than the stamping portion will stain the stamping surface to be stamped. Besides, the limitation that the portion contacting the outside air is restricted only to the stamping portion can minimize evaporation of the ink in the holder.

This invention will be further detailed with reference to an embodiment shown in FIG. 1 and FIG. 2, but the embodiment does not limit the scope of the invention.

Figure 1:
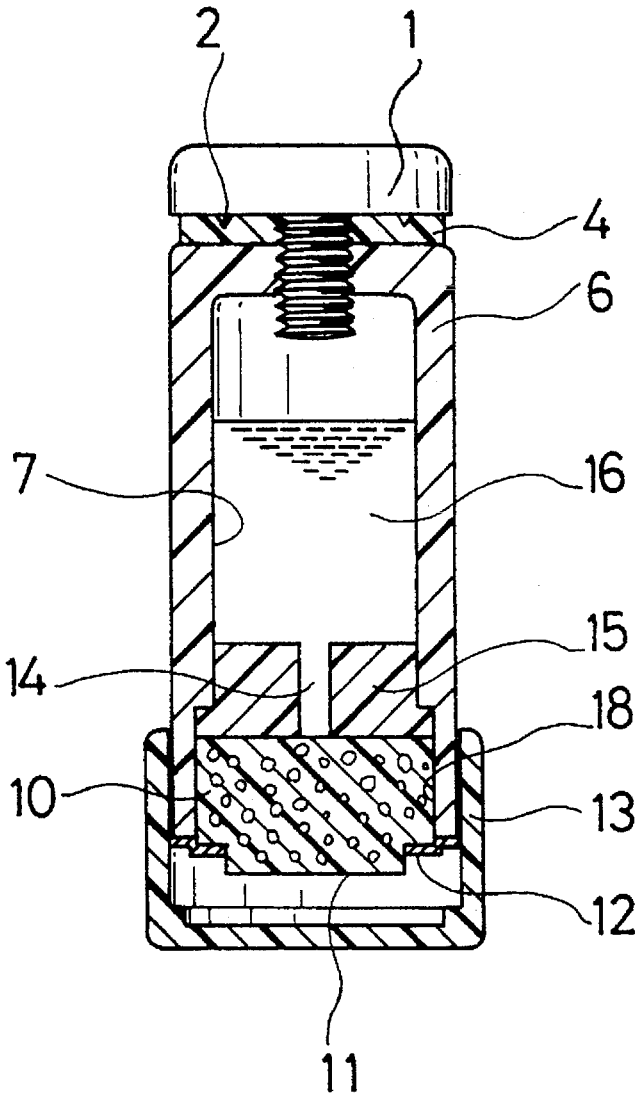
FIG. 1 is a longitudinal sectional view illustrating the whole construction of one embodiment of a hand stamp according to this invention.
Figure 2:
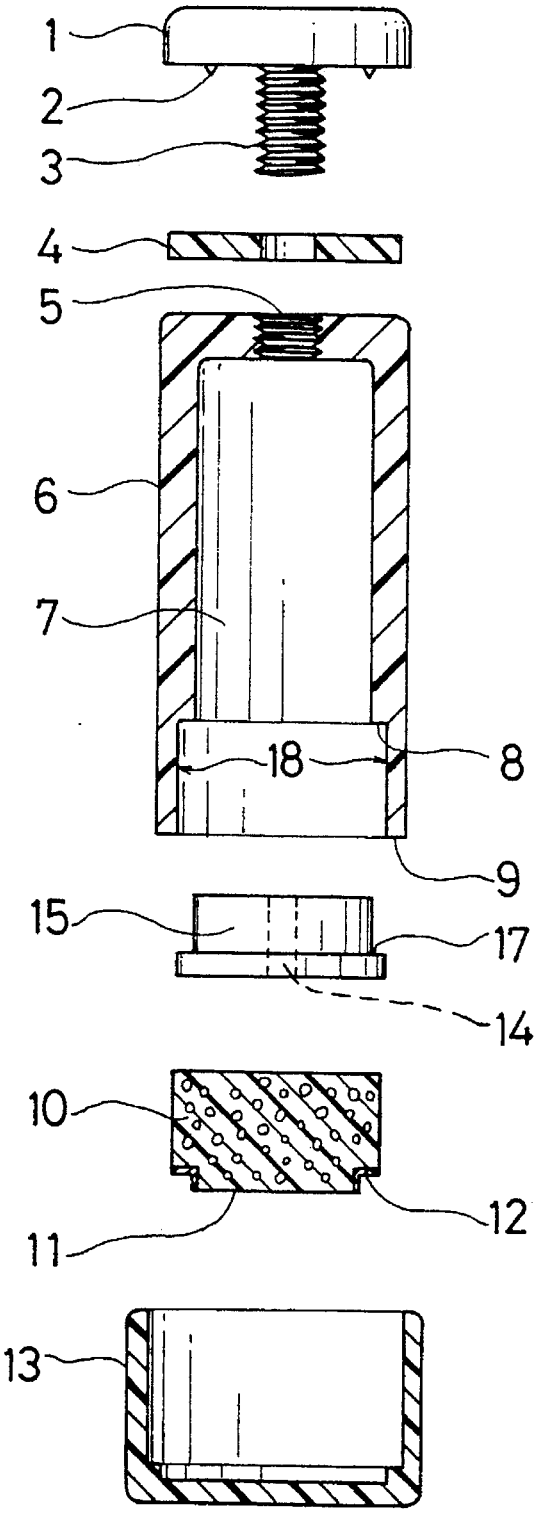
FIG. 2 is a longitudinal sectional view illustrating an exploded form of the same stamp.

FIG. 1 is a view illustrating the whole construction of one embodiment of a stamp according to this invention. Referring to FIG. 1, Reference Numeral 10 designates a disk-like stamping member. The stamping member 10 is formed of a polypropylene resin-made open-cell foam material. Reference Numeral 6 designates a polypropylene resin-made cylindrical holder. The holder 6 serves as a means for supporting the stamping member 10. The holder 6 provides inside thereof an ink housing space 7 for storing quick-drying permanent ink (quick-drying oil ink) 16 and at the lower portion thereof an opening 18 for the ink passage.

Reference Numeral 4 designates a polypropylene resin-made packing, 1 does a polypropylene resin-made threaded packing gland, and 2 does a pressing portion of the packing gland 1. Reference Numeral 15 designates a disk-like base having a through-hole 14, which allows the ink to pass therethrough at the center. The base 15 serves as a means for supporting the stamping member 10. As shown in FIG. 2, the base provides a flange 17 for engagement. Reference Numeral 13 designates a polypropylene resin-made cap which is detachably attached on the lower end of the holder 6 for protecting the stamping member 10.

The open-cell foam material constituting the stamping member 10 has a great many foams with a three-dimentional mesh structure through which the quick-drying permanent ink 16 will pass. The open-cell foam material constituting the stamping member 10 to be used preferably has a foam percentage (porosity) of 55 to 75% of the whole volume. Observation of the open-cell foam material with an electron microscope shows that the size (diameter) of one three-dimentional mesh ranges between 0.5 and 30 microns.

The under surface of the stamping member 10 constitutes the stamping surface. The stamping surface consists of a stamping portion 11 (relief) and non-stamping portion 12 (intaglio). The stamping portion 11 (relief) formed in a projecting configuration constitutes English letters and figure to be stamped in a mirror image, and this portion 11 allows passing of the stamp ink 16. The non-stamping portion 12 (intaglio) is formed lower in downward height than the stamping portion 11 wherein the entire area thereof is sealed with heat sealing, thereby preventing the stamp ink 16 from passing through the non-stamping portion 12.

The stamping portion 11 and the non-stamping portion 12 were configured in the following way. In the first process, a metal-made template mold engraved according to the desired English letters and figure is prepared. Then, the template mold is placed on a heater plate heated to 120° to 180° C. with the engraved surface upside to be heated to a predetermined temperature. Following that, a polypropylene resin-made open-cell foam material having a flat surface is forced to contact the engraved surface of the template mold in such a manner that the surface to be formed into the stamping surface keeps parallel to the heated engraved surface, and then the open-cell foam material is pressed downward with a predetermined strength to hold the pressing process for 0.2 to 3 seconds.

During the contact, pressing and holding work, the foams in the contact portion on the surface are collapsed and converted into the stamping surface, that is, open-cell foams have been thermally melted and set. The collapsed portion of the open-cell foam material is completely sealed with a polypropylene resin-made film-like coating, thereby a non-stamping portion 12 is formed.

In the process of contact, pressing and holding work, part of the surface to be formed into a stamping surface on the open-cell foam material is partially brought into the recess formed on the engraved surface of the template mold. Then, in this process, part of the surface to be formed into the stamping surface does not contact the heated recess surface (non-contact portion), thereby no heat sealing and forming the desired English letters and figure into a mirror image relief, and the stamping portion 11 is provided as a result.

In the final stage, the open-cell foam material having the stamping portion 11 and the non-stamping portion 12 thus formed is punched so as to fit the inside diameter of the opening 18 located at the lower end of the holder 6 to provide a disk-like stamping member 10.

Then the procedure of this hand stamp assembly work will be detailed with reference to FIG. 2. The base 15 with the flange 17 is first pressed into the inside wall located at the end of the holder 6, resulting in the engagement of the recess 8 on the inside wall of the holder 6 with the flange 17 of the base 15, thereby fixing the base 15 at a predetermined position. This completes a partition separating an ink housing space 7 for storing an ink 16 and a housing portion of the stamping member 10.

Once the base 15 is fixed, the stamping member 10 is pressed into the inside wall from the lower end of the holder 6 with the stamping surface directed outside to the positions that it comes into contact with the base 15 to anchor the stamping member 10 on the inside wall of the holder 6. After this work, the periphery of the lowest end of the holder 6 and the periphery of the non-stamping portion 12 are simultaneously melted with a thermal plate heated to 120° to 180° C. and set to seal them together. This completely seals the joining portion of the stamping member 10 and the holder 6, thereby preventing the stamp ink 16 from oozing out from the joining portion thereof and providing a construction free from the contact of the ink 16 with the outside air.

After attaching the base 15 and the stamping member 10 onto the holder 6, a predetermined amount of ink 16 is injected into the ink housing space 7 from the ink injection port 5 provided on the upper end of the holder 6. Incidentally, at the ink injection port 5 an internal thread portion is provided for threading an external thread portion 3 formed on the packing gland 1. Upon completing the ink 16 injection, the packing 4 is sandwiched between the upper end of the holder 6 and the packing gland 1 to clamp the external thread portion of the packing gland 1 with the internal thread portion of the ink injection port 5 by threading them together. Attaching a cap 13 on the lower end of the holder 6 completes the assembly work.

The ink 16 injected into the ink housing space 7 is automatically supplied downwardly from the back of the stamping member 10 via the through-hole 14 provided in the base 15, which enables the stamping portion 11 of the stamping member 10 to constantly hold the ink 16.

In this particular embodiment, the above quick-drying permanent ink was detailed, but the stamp according to the invention is not limited within the scope of the embodiment. It goes without saying that commercially available permanent ink (oil ink) and water ink (only in the case of stamping on a surface made of material that can absorb the ink) may be used.

Besides, in this particular embodiment, an ink refilling type stamp having the ink injection port 5 provided at the upper end of the holder 6 was detailed, but the hand stamp according to the invention is not limited within the scope of this embodiment. An ink disposal type stamp may be used containing the ink in the holder in advance and eliminating the ink injection port 5 or the like.

INTRODUCTION TO EXTENSION OF THE INVENTION

The present invention is extended with support of the following descriptions and pertinent drawings to include an improved model of the titled hand stamp.

The stamp as described so far is provided with a flat and immobile stamping member, for which reason an inconvenience is found in some usages, such as where a stamping surface is less flat or has an irregularity. In fact, where a surface to be stamped, in other words, a stamping surface is substantially flat, the inventive stamp so far described is capable of producing clear stamp marks with good consecutiveness and handy convenience without causing a stain on the printing surface, although the non-stamping portion or attachment part as explained may make a contact by chance with a stamping surface.

However, where the stamping surface is not flat, for example, it includes a step difference between two discontinuous portions, or uneven or undulating portions on the surface, the stamp previously described has difficulties in producing clear stamp marks.

This extended invention has advantages of overcoming such difficulties and of producing clear stamp marks on stamp surfaces which bear objectionable conditions as noted above, in the meantime such advantages will be kept as of minimizing loss of an ink solvent and avoiding a staining by a chance contact of the stamping surface to the stamping surfaces as noted above.

SUMMARY OF THE EXTENDED INVENTION

The extended invention provides a hand stamp which comprises a cylindrical stamping member made of an open-cell foam material and a holder means for holding the stamping member in place, and this holder means includes a cylindrical canister for storing an ink, whose shell has perforations for ink passage wherein the shell is covered or mounted for liquid sealing with a circumferential stamping member defined of an ink permeable stamping portion with relief height and an ink impermeable non-stamping portion with intaglio recess such that the ink permeable stamping portion is designed to express an intended stamping as a stamp mark; the inventive stamp further includes a frame which enables the holder, thus the canister wound with the stamping member, to roll over stamping surfaces with contact by the stamping member, wherein the periphery of the stamping member and the canister shell are sealed for liquid tight by the heat melting and fused sealing method.

As is understood, the major feature over the stamp previously described consists in transformation of the stamp or stamping member from an immobile type to a mobile or rolling type, and wherein other merits found with the previous stamp are inherited to the new roller type one. For example, as noted in the above, the stamping surface of the stamping member includes the non-stamping portion and the periphery, wherein open-cell foams located at these parts are collapsed by the heating sealing, by which structure the liquid permeable portion is restricted to the stamping portion of the stamping surface. According to such restriction, the evaporation of an ink solvent from the stored ink is inhibited a minimum.

In the present extension, the stamping member is made in a round form of cylindrical member, of which material is an open-cell foam material derived preferably from a polyolefin resin, such as polyethylene or polypropylene or the like. At the same time, the holder is preferably made of the same olefin resin as the resin for the stamping member, because the heating sealing after mounting the stamping member on the holder is facilitated when the same or homologue materials are used for two things to be heat sealed, wherein the heating conditions may be accorded to the sealing process for creating the non-stamping portion as previously explained.

The holder or canister is structured in a form of cylinder having a solid or hollow interior, and is provided with one or more ink housing spaces and with a plurality of perforations on the shell wall for ink passage. In the case of ink-refilling type, the holder is further provided with an ink port and a stopper. Then, the stamping member with a mirror image of an intended stamping content is mounted covering the shell area of the holder structure or canister such that the plurality of the perforations for ink passage communicates with the inside of the stamping member. And these two things are heat sealed between the inside of the stamping member and the two end flanges of the holder or selected shell areas of the holder (in the case where the stamping member's length is to a degree shorter than longitudinal length of the holder).

BRIEF DESCRIPTION OF THE ADDITIONAL DRAWINGS

Figure 3:
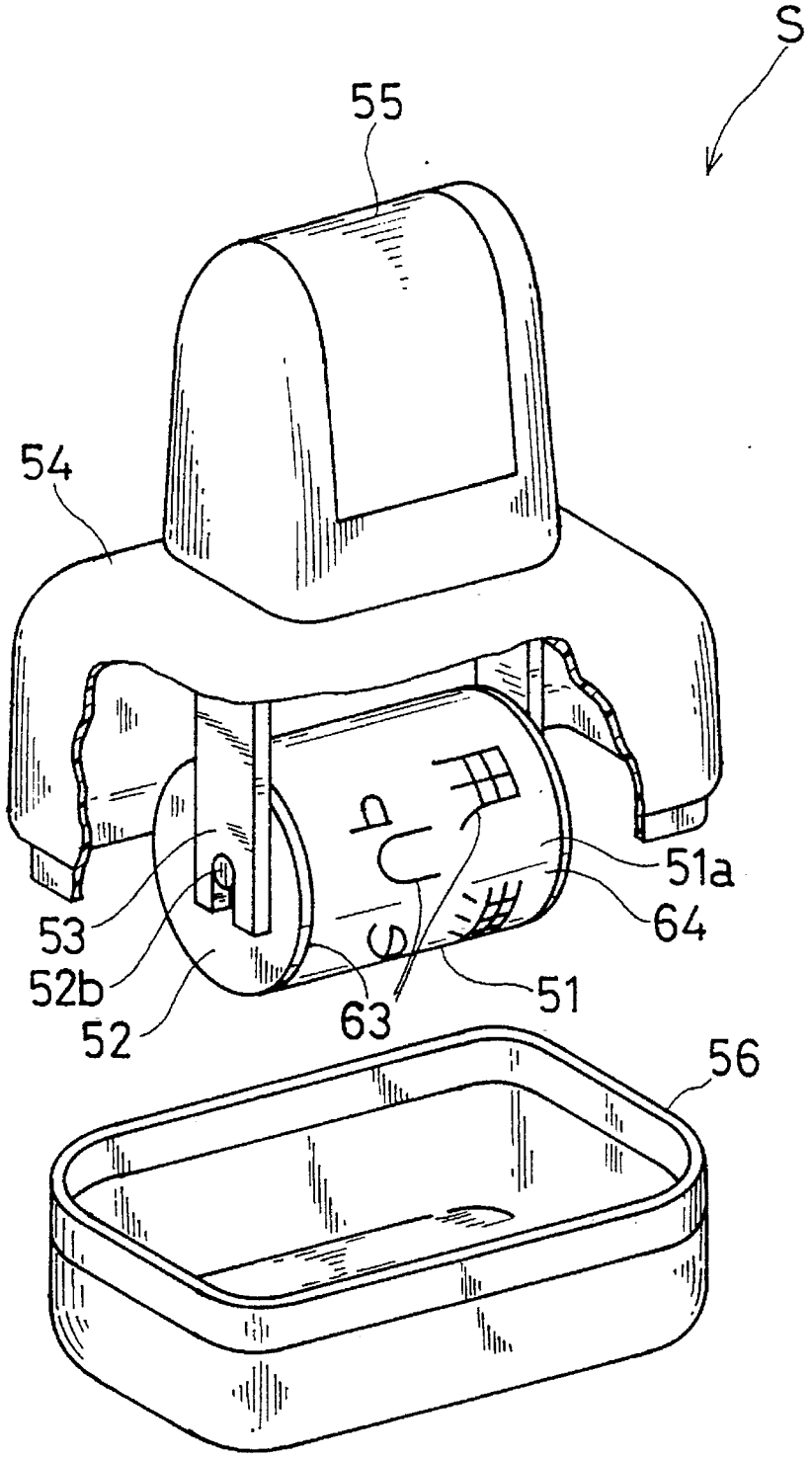
Figure 4:
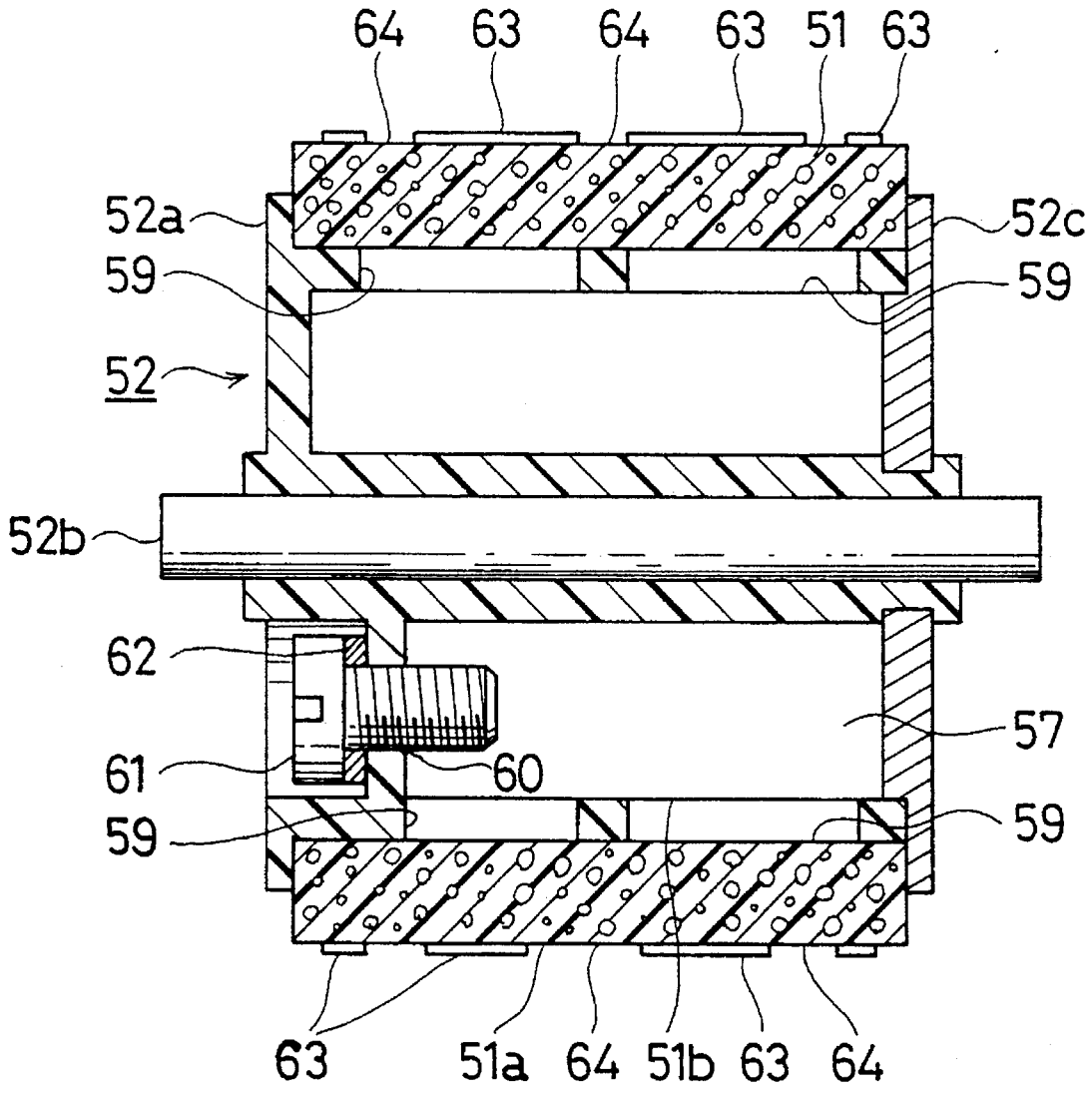
Figure 5:
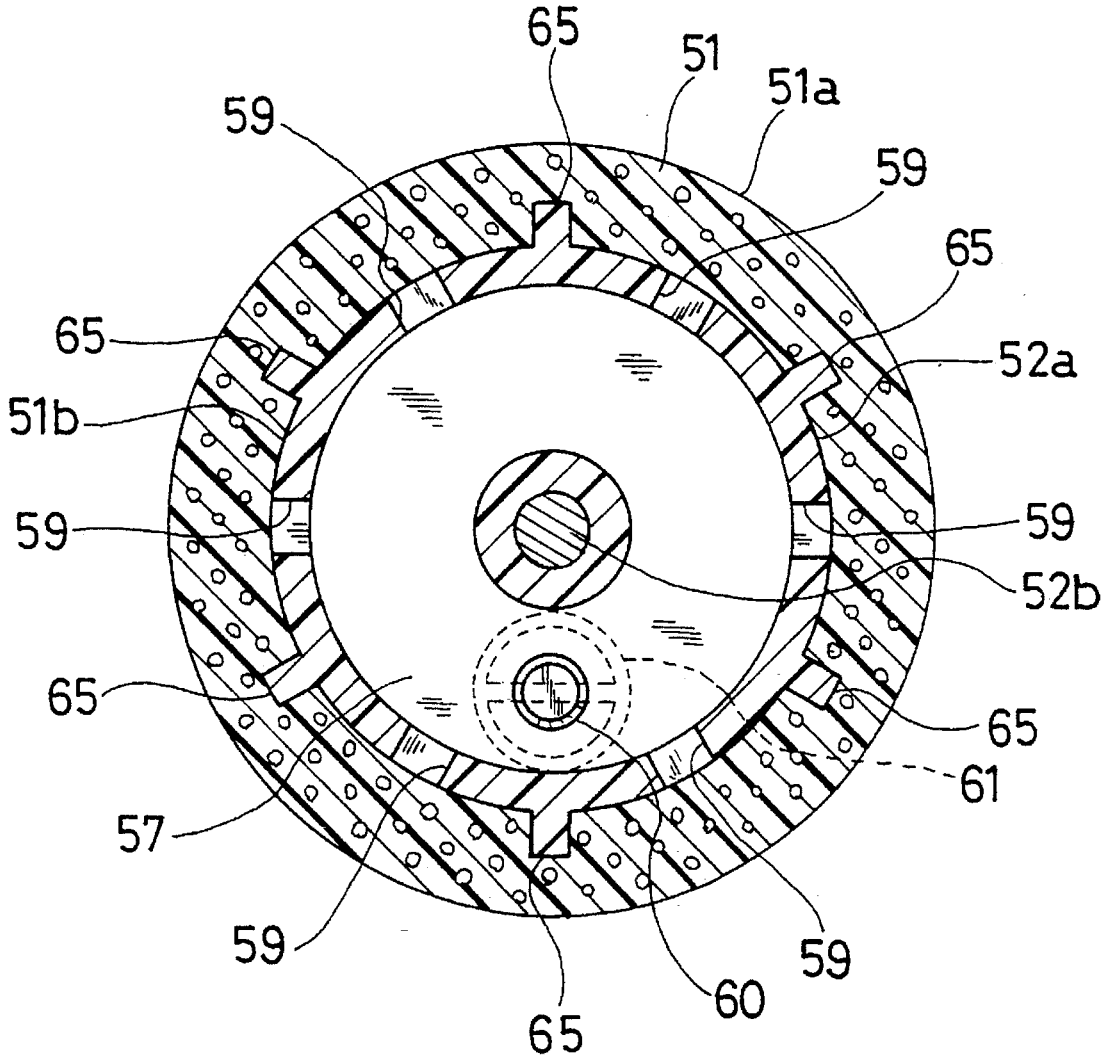
Figure 6:
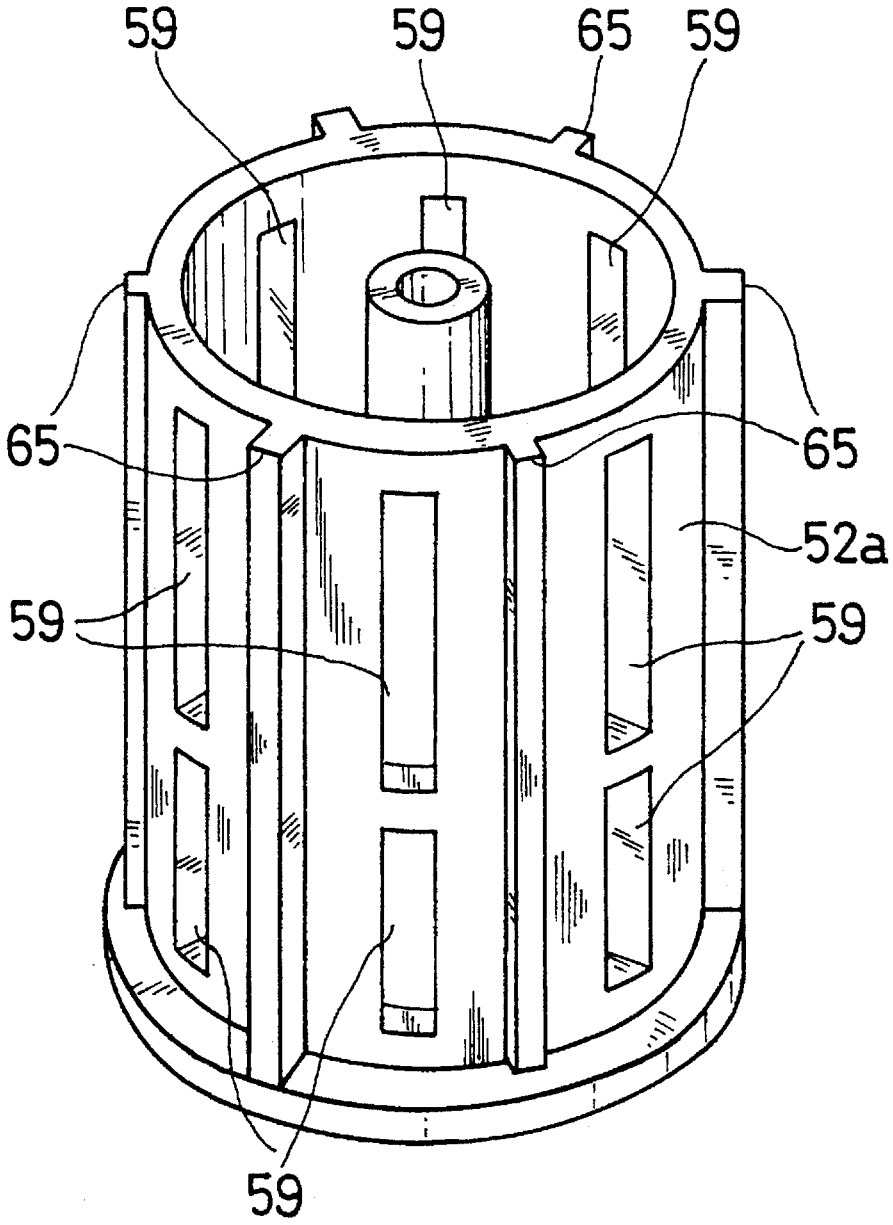
Figure 7:
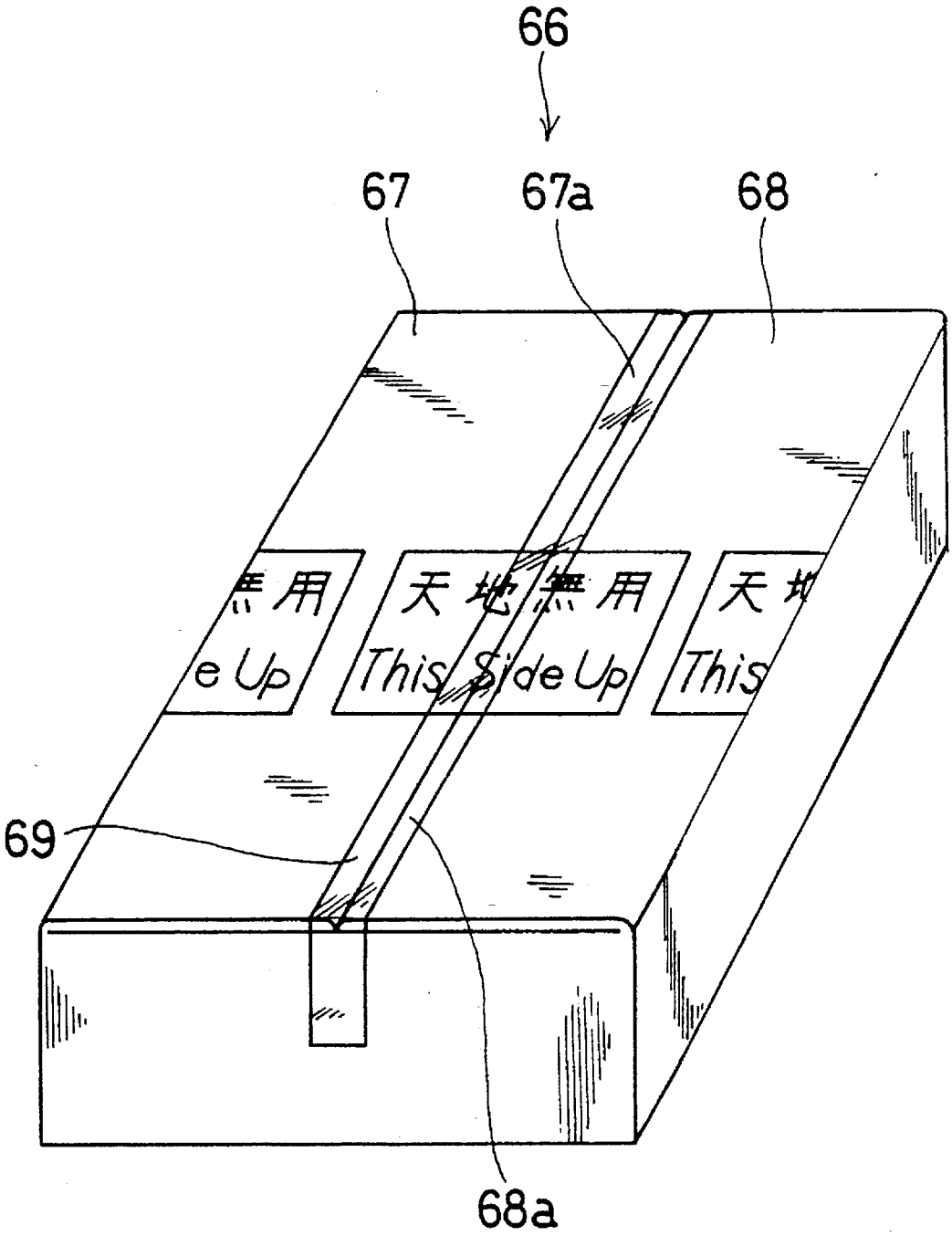

The additional invention will be detailed with reference to the drawings in which:

FIG. 3 is a perspective view illustrating the whole construction with a partial cutaway of one embodiment of a stamp according to this invention;

FIG. 4 is a schematic, longitudinally sectioned view of key portions of the stamp according to this invention;

FIG. 5 is a schematic, cross-sectioned view of key portions of the stamp according to this invention;

FIG. 6 is a schematic, perspective view illustrating of the holder according to this invention; and FIG. 7 is a perspective view illustrating stamp marks stamped on a box by the one embodiment stamp.

DETAILED DESCRIPTION OF THE PREFERRED EMBODIMENT

In the following, one embodiment of the extended invention will be illustrated, but the invention is not limited by this illustration.

In FIG. 3, the reference letter S indicates the whole stamp, 55 designates a handle, 54 does a casing, 53 does a frame for mounting a roller type holder 52, and 56 does a cap to removably house the skirting end of the casing 54. The stamp S further includes a cylindrical stamp member 51, of which apparent surface defines a stamping surface 51*a*. This surface 51*a* is allowed to roll about a shaft 52*b* which is mounted with two forked ends of the frame 53 as will be detailed later.

The stamping member 51 is made of an open-cell foam material permeable to a quick dry permanent ink (quick dry oily ink) for stamping use, and the material is polypropylene resin containing a countless number of foams with three-dimensional mesh structure, whose preferable porosity range as previously noted to be 55 to 75% and whose size range as previously noted to be 0.5 to 30 microns by the electron microscope observation are valid in this embodiment.

The holder 52 as shown in FIGS. 4 to 6 is made of polypropylene resin and comprised of a holder structure or canister 52*a* in the shape of a hollow cylinder having an axial tube inside thereof and a port 60 at one end wall, wherein a shaft 52*b* penetrates to secure the axial tube of the cylindrical housing, and a holder cap 52*c* is mounted to form an end wall other than the wall having the port 60.

The interior space 57 provided in an annulus inside the cylindrical holder 52 is a space for housing or storing an ink, such as a quick dry permanent ink. And the shell wall of the cylindrical holder structure 52*a* has slots 59, each running axially, for ink passage in such a manner that, as is shown in FIG. 6, the shell wall is circumferentially divided into six portions with six axially running ribs 65 which are arranged with equi-sections of one revolution about the shaft axis 52*b*, and that two slots 59 are axially lined with a space in each shell wall interspace between adjacent two ribs 65. Further in connection with the ink port 60, a threading port stopper 61 is provided together with a packing 62 made of polyurethane.

The frame 53, casing 54, and handle 55 are made of polyacetal resin colored in a desired color. The cap 56 is transparent and made of polypropylene resin.

The stamping member 51 has an outer surface which is apparent in FIG. 3 and this surface has been named stamping surface 51*a* which is comprised of a stamping portion 63 and a non-stamping portion 64, wherein, as already described, Japanese and English letters, if desired any figures, are patterned in a mirror image with relief and intaglio configurations, and thereby the ink can only pass through the relief stamping portion 63, because the non-stamping portion 64 is deprived or collapsed of foams by the heat sealing.

The process of patterning the stamping portion 63 and the non-stamping portion 64 on the stamping surface 51*a* will be described. That is, as the first step, a metallic template mold is prepared, whose upper face has been engraved to describe in intaglio the Japanese letters as transliterated into "TENCHI MUYOU (天地無用)" and English letters "THIS SIDE UP" (the Japanese letter means the same) in a double line format. As the next step, a heater heated up to 120 to 180 centigrades is prepared, and the engraved template thus prepared is placed on this heater with the engraved face upside.

Then an open-cell foam material having the quality as noted which has been made round and further assembled with the holder 52, is placed on an end of the heated template, and the holder 52 is rolled slowly over the template with downward pressure so as to heat up the contacted portion to a predetermined temperature, thereby the intaglio pattern is transferred or the relief portion is impressed to the foam material as will be understood by the previous descriptions.

Through the process of contacting, pressing, and rolling, the contractual and pressed portion of the open-cell foam material is converted into the non-stamping or intaglio portion 64 of the stamping surface 51*a* wherein the heat effect has served to form an impermeable polypropylene film.

In the meantime, through the same process of contacting, pressing, and rolling, part of the surface of the open-cell foam material is left uncontactual, unpressed onto the template because the part at issue was assigned to the intaglio portion of the template. This part has maintained the open-cell foam structure and defines the stamping portion 63 having the designed pattern for stamping. In this case, a mirror image of designed Japanese and English letters is formed.

Next, assembling process of the stamp S will be explained. First, a stamping member 51 in the shape of a round belt is mounted over the holder structure or canister 52*a* so as to cover the ribs 65 and thus all circumferential or shell areas which provide the slots 59, and then a holder cap 52*c* is mounted to an end of the cylindrical holder, thereby the stamping member 51 is rendered to be supported by the holder 52. It is to be noted here that the ribs 65 contribute to avoid possible internal sways or partial dislocations of the stamping member 51 as is seen from FIGS. 5 and 6, wherein the internal surface 51*b* of the stamping member 51 is wound on the circumferential face of the holder structure 52*a*.

After the stamping member 51 has been mounted in place, the heat sealing is given to seal peripheries of the stamping member 51 and the holder structure 52*a*, to which purpose a ring heater having a diameter to encompass the mounted stamping member 51 is used. Specifically, such a ring heater is applied to heat up the appropriate peripheries to 120 to 180 centigrades and held for 0.2 to 3 sec. In a similar way, the heat sealing is applied to the boundary or sealing portion between the holder structure 52*a* and the holder cap 52*c*.

Following to heat sealing, the ink port 60 of the holder 52 with the stamping member 51 mounted is used to charge an ink into the ink housing space 57 at a predetermined volume, and then the port 60 is closed by the stopper 61 with aid of a packing 62. And the holder 52 with the stamping member 51 is mounted to the frame 53 for preparation to rolling, and then the casing 54 is mated with the cap 56.

Referring to the stamping mechanism, the ink stored in the ink housing space 57 permeates automatically outwardly through the stamping member 51, thereby the stamping portion 63 of the stamping surface 51*a* is constantly wetted with the ink, in readiness for use at any time.

FIG. 7 shows an illustration that the stamp S is used to stamping on a carton box 66, on which upper surface there is a gap between two side flaps 67, 68, wherein a casement closure line formed of two edge lines 67*a*, 68*a* is pressed with a transparent tape 69. As is seen, the stampings of double line writing are marked in consecutive side by side manner by rolling of the stamp S of the present invention, wherein the consecutive stampings run over the tape 69 lying uneven or in step irregularity, but the stamp mark on the tape 69 produces as legible letters as well as other stamp marks: "This Side Up" and the Japanese letters as noted above.

As has been described, the stamp S of the present invention is equipped with a rolling stamping member 51 mounted on the core-forming holder 52 which supports the stamping member 51 to be rollable, wherein the liquid tight sealing is completely provided excepting the stamping portion 63 of the stamping surface 51*a*, that is, only the stamping portion 63 allows the inks to pass out. Accordingly, contacts of the non-stamping portion 64 of the stamping surface 51*a* or peripheral parts thereof do not cause staining with the ink any stamping surfaces even if such surfaces are uneven or undulating.

In the case of the stamp S of the present invention, the area accessible to atmospheric air is limited to the stamping portion 63, and therefore the evaporation of the stored ink is inhibited a minimum, thereby dispensing with frequent ink refillings as necessary to convention art.

Further, the descriptions above have illustrated the use of a quick dry permanent ink, but such do not limit the scope of applicable inks, that is, general permanent inks belonging to the concept of oil or water inks are available. In addition, the descriptions on the embodiment have illustrated such an arrangement as the ink port 60 is provided with the holder 52 for ink refilling, but such do not limit the scope of the present invention wherein a disposal type stamp having no ink port is included.

What is claimed is:

1. A hand stamp comprising a holder means which includes an ink storing space and a stamping member connected to said holder means, said stamping member being made of an open-cell foam material partially heat sealed to form an ink impermeable area with a remainder area for ink permeation to effect a stamping, said ink impermeable area defining intaglio portions formed by press in the heat sealing and said ink permeable portions defining relief portions, and wherein said relief portions collectively define an image that is transferred to a surface when the hand stamp is pressed against such surface.

2. A hand stamp as defined in claim 1, wherein the holder means has an opening for ink passage and said stamping member is immobile and bond attached to the opening of the holder means.

3. A hand stamp as defined in claim 1, wherein said stamping member is mobile and encompasses a cylindrical holder circumference, and the holder means is allowed to roll.

4. A hand stamp as defined in claim 3, additionally comprising spaced apart axially running ribs at the cylindrical holder circumference and axially extending slots disposed between the ribs, and wherein the stamping member in a round form is mounted on the axially running ribs protruding radially.

5. A hand stamp as defined in claim 3, wherein said holder means is cylindrical and has an interior space for storing ink and a plurality of slots for ink passage on the holder circumference communicating with the stamping member.

6. A hand stamp as defined in claim 1, wherein said open-cell foam material has a porosity of 55 to 75% and a foam size ranges 0.5 to 30 microns.

7. A hand stamp as defined in claim 1, wherein said open-cell foam material and said holder means are both made of the same resin belonging to polyolefin resin family.

8. A hand stamp as defined in claim 7, wherein said open-cell foam material and said holder means are both made of polypropylene resin.

9. A hand stamp as defined in claim 7, wherein said open-cell foam material and said holder means are both made of polyethylene resin.

10. A hand stamp as defined in claim 1, wherein said holder means has a port for refilling ink.

11. A hand stamp as defined in claim 1, said hand stamp further includes a cap for housing the stamping member.

12. A hand stamp as defined in claim 1, wherein said intaglio portions are formed by the heat sealing which comprises pressing an open-cell foam material onto a heated template mold while said relief portions are formed by non-contact onto a heated template mold during the pressing.

13. A hand stamp comprising a holder which includes an ink storing space and a stamping member connected to said holder, said stamping member being made of an open-cell foam material partially heat sealed to form an ink impermeable area with a remainder area for ink permeation to effect a stamping, said ink impermeable area defining intaglio portions formed by press in the heat sealing and said ink permeable portions defining relief portions for the stamping, wherein said stamping member and said holder are made of the same polyolefin resin, and said stamping member and said holder are heat sealed at a boundary in the outer surface of said stamping member which boundary contacts said holder for preventing ink from leaking from the boundary.

* * * * *